US011735848B2

(12) United States Patent
Wang et al.

(10) Patent No.: US 11,735,848 B2
(45) Date of Patent: Aug. 22, 2023

(54) ELECTRICAL CONNECTOR HAVING A METALLIC COVER AND A COUPLING PIECE GROUNDING THE METALLIC COVER TO AN INTERNAL PRINTED CIRCUIT BOARD

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Cai-Yuan Wang, Kunshan (CN); Zhi-Yong Zhou, Kunshan (CN); Ying-Xing Ma, Kunshan (CN); Chien-Hsun Huang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/506,870

(22) Filed: Oct. 21, 2021

(65) Prior Publication Data

US 2022/0131293 A1 Apr. 28, 2022

(30) Foreign Application Priority Data

Oct. 23, 2020 (CN) ..... 202011144908.1

(51) Int. Cl.
*H01R 12/72* (2011.01)
*H01R 13/502* (2006.01)
(Continued)

(52) U.S. Cl.
CPC ..... *H01R 12/724* (2013.01); *H01R 13/502* (2013.01); *H01R 13/516* (2013.01); *H01R 13/6471* (2013.01); *H01R 13/652* (2013.01)

(58) Field of Classification Search
CPC .. H01R 12/721; H01R 12/722; H01R 12/724; H01R 12/727; H01R 12/73;
(Continued)

(56) References Cited

U.S. PATENT DOCUMENTS 6,089,882 A * 7/2000 Costello ..... H01R 13/6583 439/95
8,221,139 B2 7/2012 Qin et al.
(Continued)

FOREIGN PATENT DOCUMENTS

CN 107799211 A 3/2018
CN 111082267 A 4/2020

*Primary Examiner* — Marcus E Harcum
(74) *Attorney, Agent, or Firm* — Ming Chieh Chang

(57) ABSTRACT

An electrical connector includes: an insulative housing having a recess at an outer surface thereof; plural contacts secured to the insulative housing and each including a securing portion, a front contacting portion, and a rear tail; an internal printed circuit board (PCB) having plural conductive pads connected to the rear tails of the contacts and an auxiliary ground pad; a metallic cover enclosing the insulative housing; and a coupling piece received in the recess of the insulative housing, the coupling piece either connecting the metallic cover to the auxiliary ground pad of the PCB or connecting the metallic cover to a corresponding ground contact of the plurality of contacts or both.

7 Claims, 20 Drawing Sheets

(51) Int. Cl.
*H01R 13/516* (2006.01)
*H01R 13/6471* (2011.01)
*H01R 13/652* (2006.01)

(58) Field of Classification Search
CPC .. H01R 12/732; H01R 13/502; H01R 13/516; H01R 13/6471; H01R 13/652; H01R 13/6582; H01R 13/6591; H01R 13/6594; H01R 13/6597; H01R 13/6595
See application file for complete search history.

(56) References Cited

U.S. PATENT DOCUMENTS 8,292,630 B1 * 10/2012 Bobuk ..... H01R 12/73 439/74
8,864,506 B2 10/2014 Little et al.
9,300,064 B2 * 3/2016 Takenaga ..... H01R 12/716
9,401,570 B2 7/2016 Phillips et al.
9,496,653 B2 * 11/2016 Little ..... H01R 13/6582
9,614,308 B2 * 4/2017 Ozeki ..... H01R 13/6581
9,825,407 B2 * 11/2017 Wu ..... H01R 12/53
9,979,145 B2 * 5/2018 Wu ..... H01R 13/6591
9,997,853 B2 * 6/2018 Little ..... H01R 13/6471
10,062,989 B2 * 8/2018 Little ..... H01R 13/6582
10,333,243 B2 * 6/2019 Tang ..... H01R 12/7011
10,367,313 B2 * 7/2019 Wu ..... H01R 13/6585
10,381,776 B2 * 8/2019 Wu ..... H01R 13/665
10,396,499 B1 * 8/2019 Shen ..... H01R 13/6594
10,403,991 B2 * 9/2019 Takeuchi ..... H01R 13/6275
10,411,408 B2 * 9/2019 Wu ..... H01R 13/6272
10,439,332 B2 * 10/2019 Ju ..... H01R 13/6581
10,673,159 B2 * 6/2020 Ishida ..... H01R 12/721
10,811,824 B2 * 10/2020 Teruki ..... H01R 12/716
10,923,854 B2 * 2/2021 Tanaka ..... H01R 13/6275
2008/0214051 A1 * 9/2008 Obikane ..... H01R 12/716 439/607.41
2010/0210124 A1 * 8/2010 Li ..... H01R 12/724 439/108
2014/0227910 A1 * 8/2014 Tanaka ..... H01R 13/04 439/626
2017/0077651 A1 * 3/2017 Chang ..... H01R 24/64
2021/0175649 A1 * 6/2021 Amemori ..... H01R 13/6594
2021/0175665 A1 * 6/2021 Someya ..... H01R 13/629
2021/0359474 A1 * 11/2021 Oosaka ..... H01R 13/6586
2021/0384679 A1 * 12/2021 Liao ..... H01R 13/53
2022/0115816 A1 * 4/2022 Huang ..... H01R 13/6594

* cited by examiner

ELECTRICAL CONNECTOR HAVING A METALLIC COVER AND A COUPLING PIECE GROUNDING THE METALLIC COVER TO AN INTERNAL PRINTED CIRCUIT BOARD

BACKGROUND OF THE INVENTION

1. Field of the Invention

The present invention relates to an electrical connector comprising an insulative housing, a plurality of contacts secured to the insulative housing, an internal printed circuit board (PCB) having a plurality of conductive pads connected to the plurality of contacts, and a metallic cover enclosing the insulative housing, wherein a grounding element is provided for connecting the metallic cover to the PCB.

2. Description of Related Arts

China Patent No. 107799211 discloses an electrical connector including an insulative housing, a plurality of contacts secured to the insulative housing, an internal printed circuit board (PCB) having a row of conductive pads connected to the plurality of contacts and a pair of auxiliary ground pads at two outer sides of the row of conductive pads, and a metallic cover enclosing the insulative housing, wherein the metallic cover has a pair of integral clips connected to the pair of auxiliary ground pads of the PCB.

SUMMARY OF THE INVENTION

An electrical connector comprises: an insulative housing having a recess at an outer surface thereof; plural contacts secured to the insulative housing and each including a securing portion, a front contacting portion, and a rear tail; an internal printed circuit board (PCB) having plural conductive pads connected to the rear tails of the contacts and an auxiliary ground pad; a metallic cover enclosing the insulative housing; and a coupling piece received in the recess of the insulative housing, the coupling piece either connecting the metallic cover to the auxiliary ground pad of the PCB or connecting the metallic cover to a corresponding ground contact of the plurality of contacts or both.

DETAILED DESCRIPTION OF THE PREFERRED EMBODIMENTS

Figure 1:
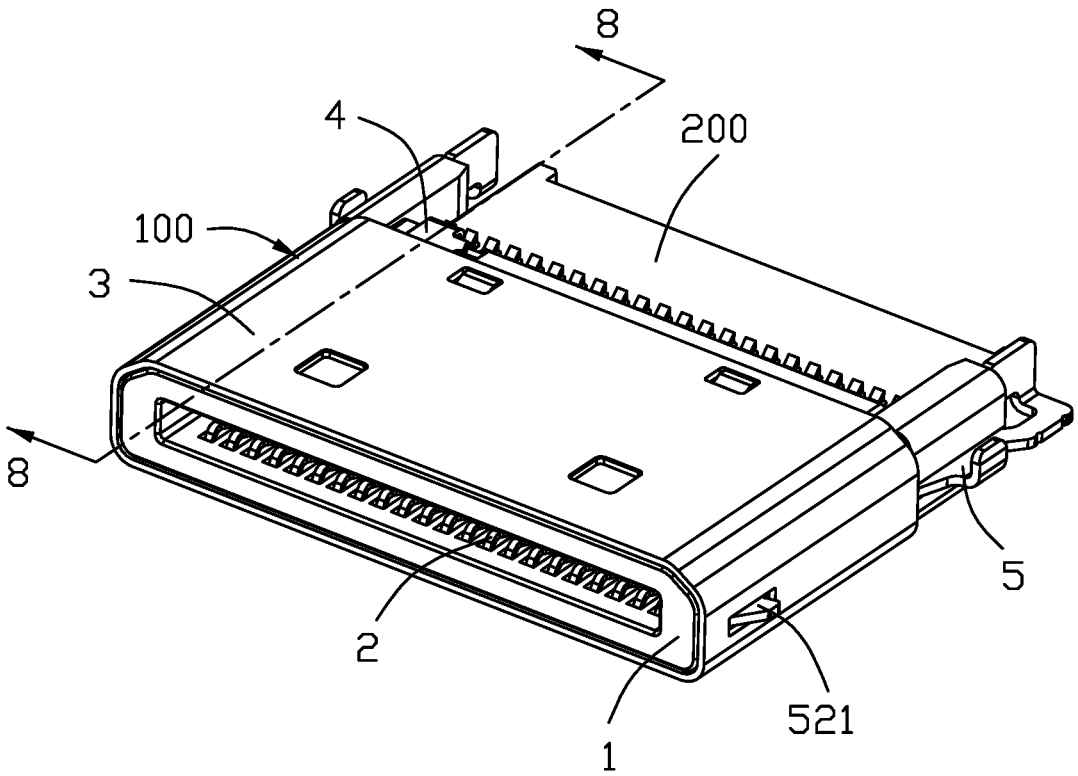
FIG. 1 is a perspective view of an electrical connector in accordance with a first embodiment of the present invention.
Figure 2:
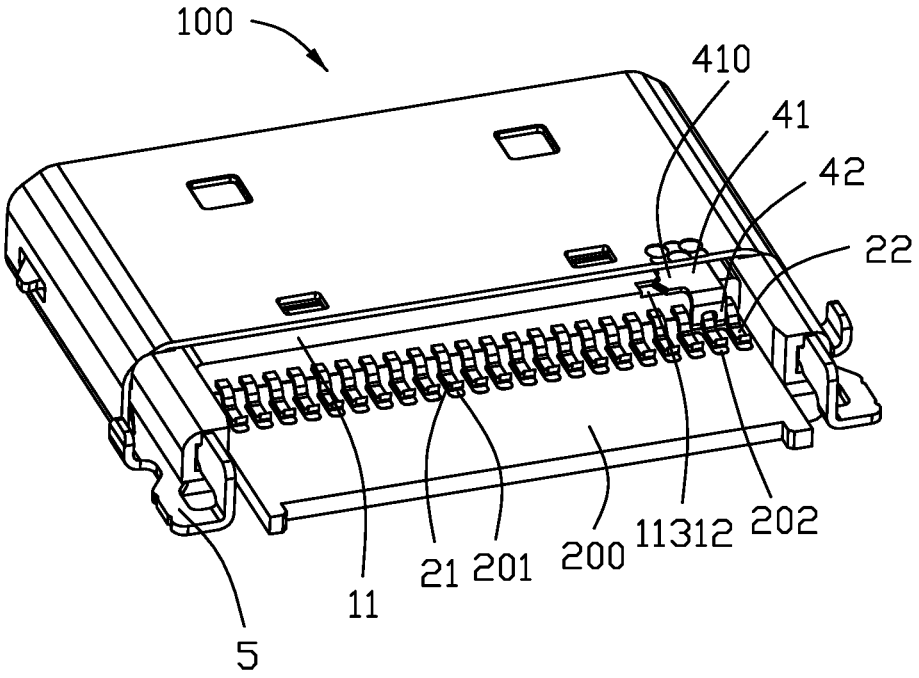
FIG. 2 is another perspective view of the electrical connector.
Figure 3:
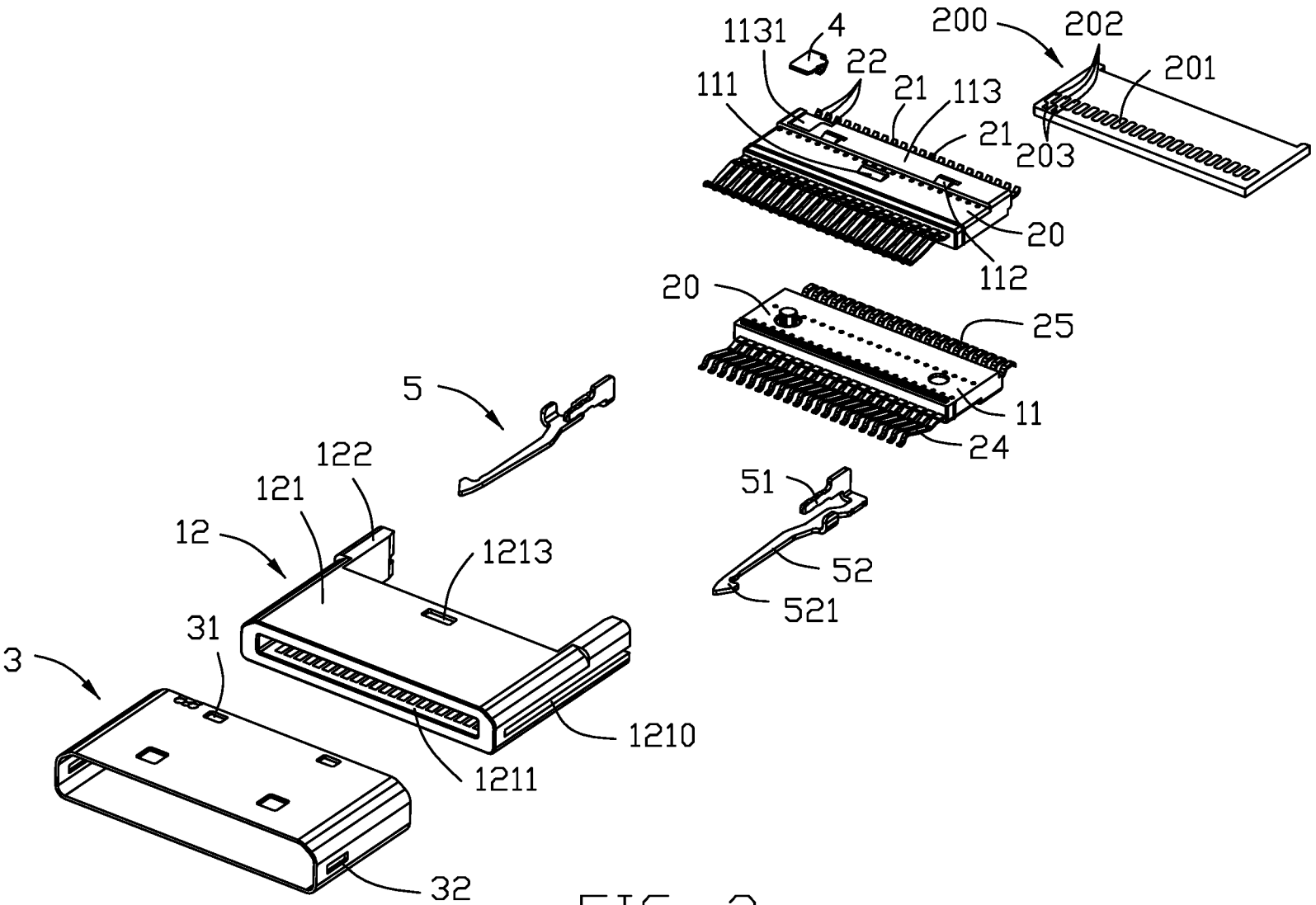
FIG. 3 is an exploded view of the electrical connector.
Figure 4:
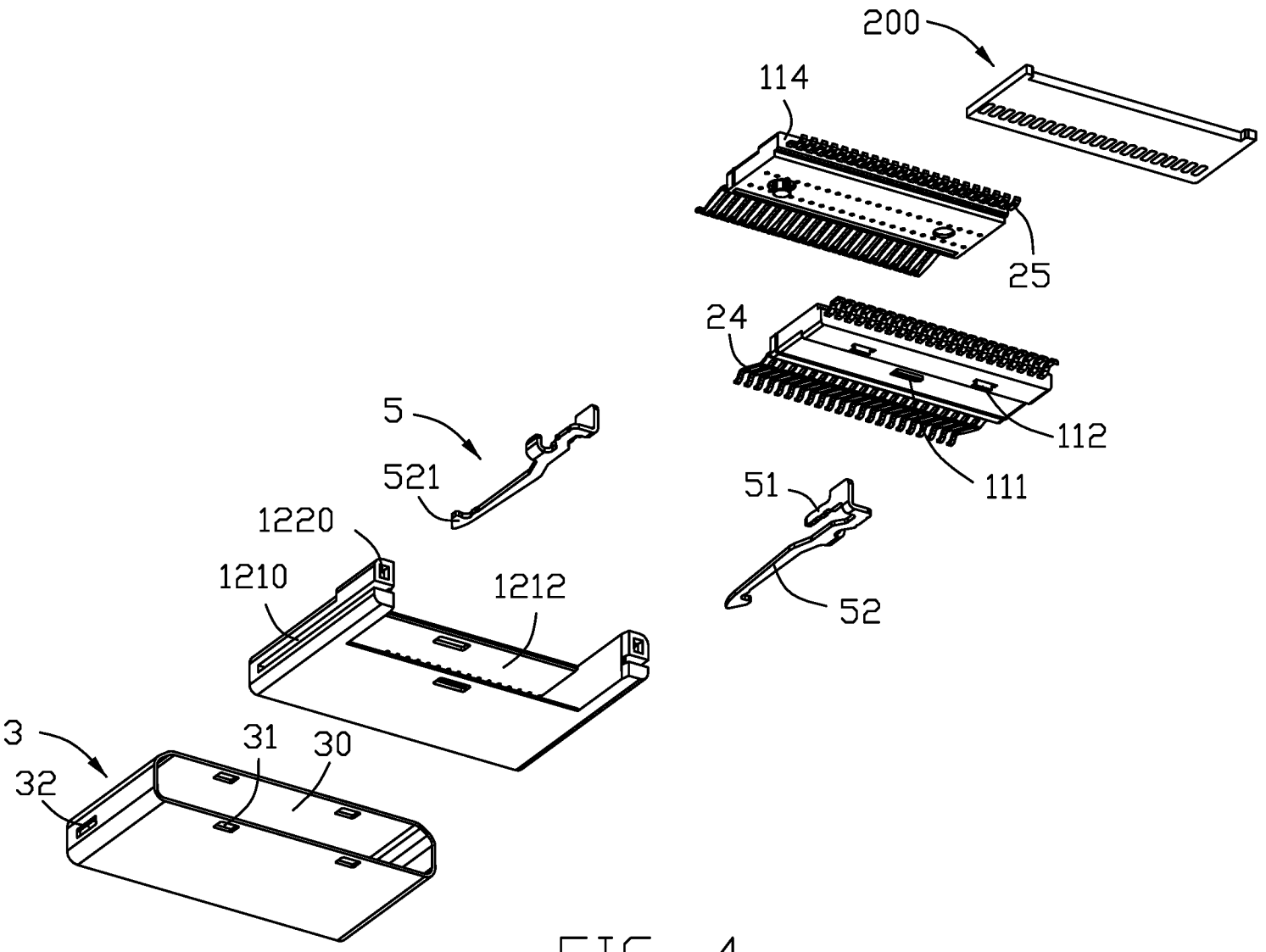
FIG. 4 is another exploded view of the electrical connector.
Figure 5:
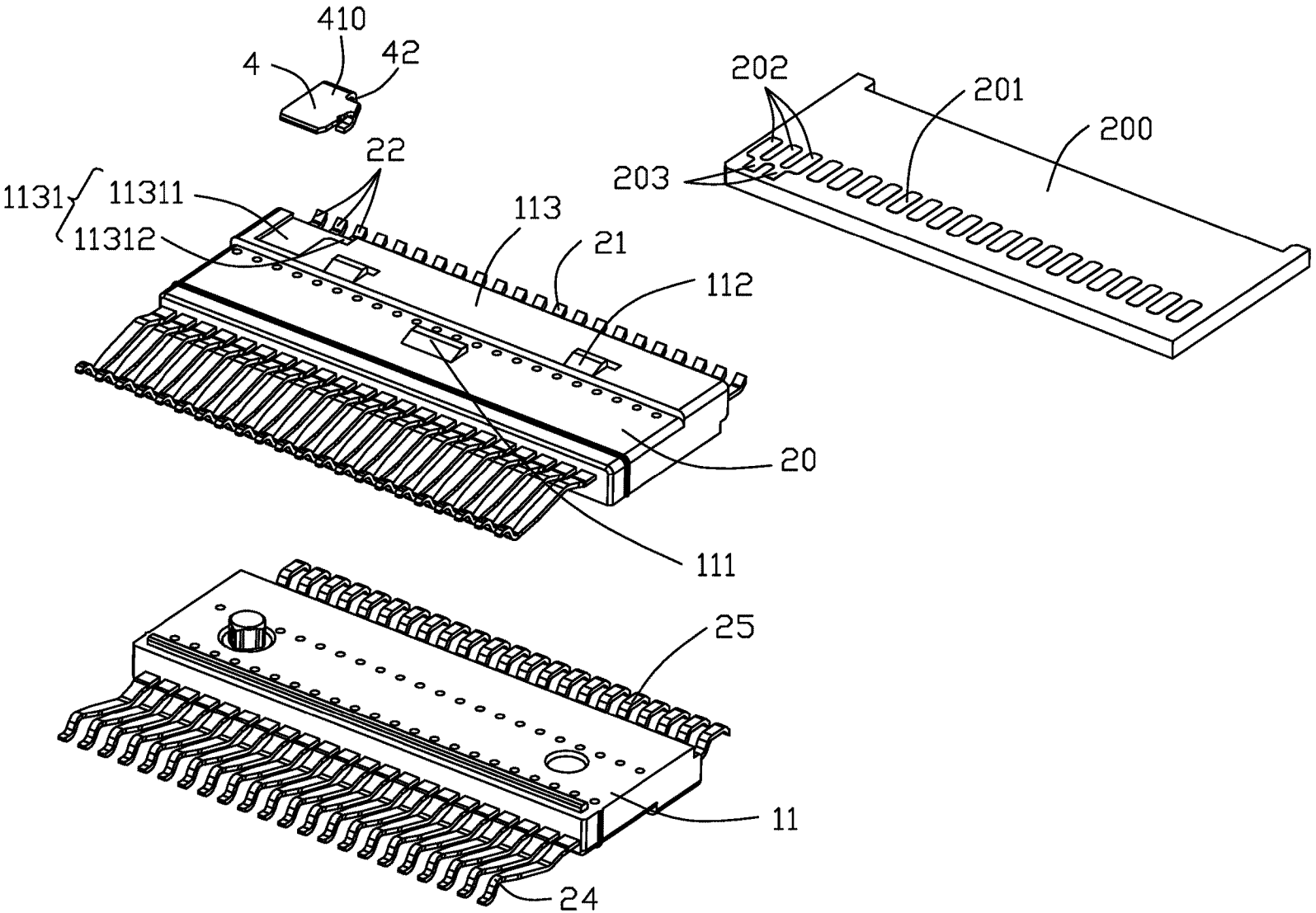
FIG. 5 is an exploded view showing a part of the electrical connector.
Figure 6:
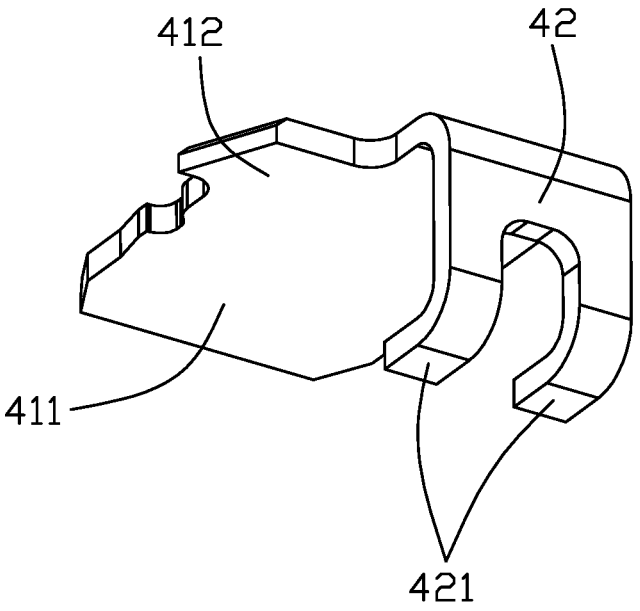
FIG. 6 is a perspective view of a coupling piece of the electrical connector.
Figure 7:
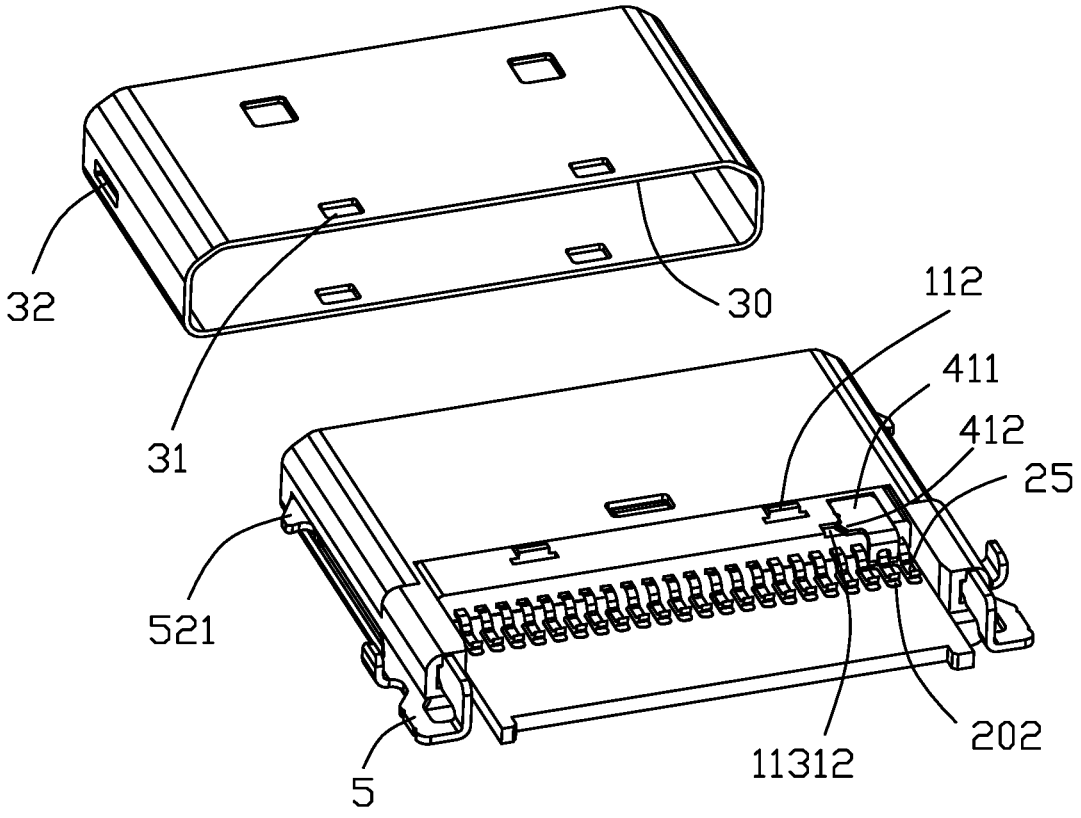
FIG. 7 is a partially exploded view of the electrical connector.
Figure 8:
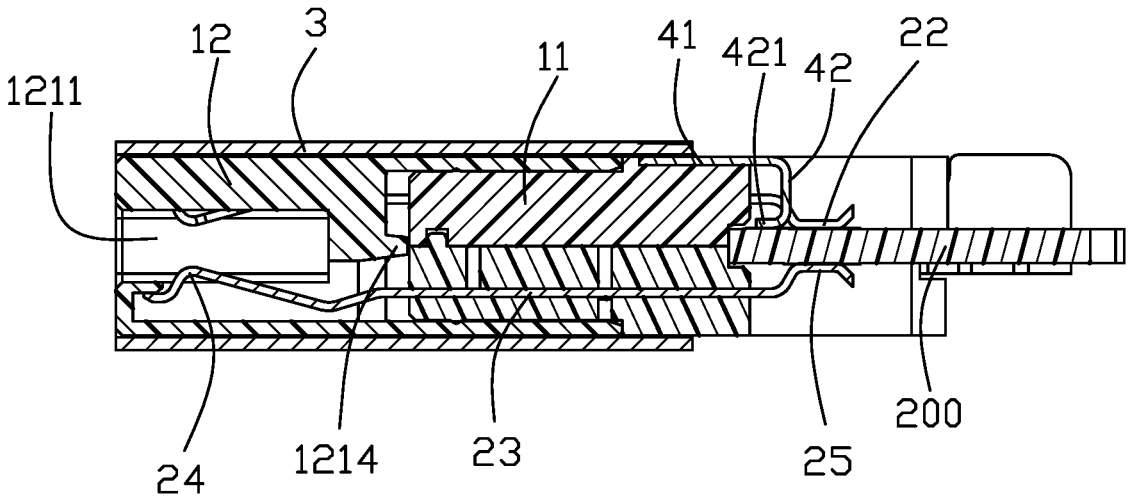
FIG. 8 is a cross-sectional view of the electrical connector taken along line A-A in FIG. 1.

Referring to FIGS. 1-8, an electrical connector 100 comprises an insulative housing 1, two rows of contacts 2 secured to the insulative housing 1, an internal printed circuit board (PCB) 200 having a plurality of conductive pads connected to the contacts 2, a metallic cover 3 enclosing the insulative housing 1, and a coupling piece 4 sandwiched between the insulative housing 1 and the metallic cover 3. The metallic cover 3 preferably does not have any soldering legs. The electrical connector 100 may further comprise a pair of latches 5 secured to the insulative housing 1. As is known in this art, a rear end of the PCB 200 may be connected to a cable through any appropriate means to obtain a cable end connector.

The insulative housing 1 includes two insulators 11 and an insulative case 12. Each insulator 11 and one row of contacts 2 constitute a respective contact module 20. Each row of contacts 2 include signal contacts 21 and ground contacts 22. Each contact 2 has a securing portion 23, a front contacting portion 24, and a rear tail 25. The insulative case 12 has a main body 121 and a pair of side arms 122. The main body 121 has a front mating chamber 1211 and a rear mounting chamber 1212. The two contact modules 20 are received in the mounting chamber 1212 between the pair of side arms 122. The main body 121 has a pair of mounting holes 1213 and the insulators 11 have corresponding lugs 111. Between the front mating chamber 1211 and the rear mounting chamber 1212 there is a block 1214 stopping the insulators 11 while allowing the contacting portions 24 to extend through grooves thereof. The metallic cover 3 may be seamless and has one or more holes 31 for engaging corresponding lugs 112 of the insulators 11. Each latch 5 includes a fixing part 51 and a flexible arm 52 having a latch 521.

The PCB 200 is clamped between two rows of tails 25 of the contacts 2 and has signal conductive pads 201 for signal contacts 21 and ground conductive pads 202 for ground contacts 22. The insulator 11 has a recess 1131 formed in an outer surface 113 thereof that opposes an inner surface 30 of the metallic cover 3. The coupling piece 4 is received in the recess 1131. The coupling piece 4 has a planar portion 41 secured in the recess 1131 and a tail portion 42 bent from the planar portion 41. An upper surface 410 of the planar portion 41 is in contact with the inner surface 30 of the metallic cover 3. The tail portion 42 has at least one foot 421 extending forwardly. The PCB 200 has auxiliary ground pad 203 for soldering the foot 421. Therefore, the metallic cover 3 may be grounded to the PCB 200 by way of the coupling piece 4. If desired, the upper surface 410 of the planar portion 41 may be secured to the inner surface 30 of the metallic cover 3 by soldering or spot welding.

In the first embodiment, the recess 1131 has a front fixing portion 11311 and a wider rear limiting portion 11312 extending through a rear surface 114 of the insulator 111. Correspondingly, the planar portion 41 has a front fixing part 411 and a wider rear limiting part 412. By forwardly inserting the planar portion 41 into the recess 1131, the planar portion 41 is interference fit in the recess 1131 at a designed depth. The contacts 2 may have two adjacent ground contacts 22 and the PCB 200 may have two corresponding ground pads 202. The auxiliary ground pad 203 may be constructed by extending and joining front ends of the two adjacent ground contacts 22. More than one auxiliary ground pad 203 may be designed in this manner. In the first embodiment, the contacts 2 include three adjacent ground contacts 22 and the PCB 200 has three ground pads 202 and two auxiliary ground pads 203.

Figure 9:
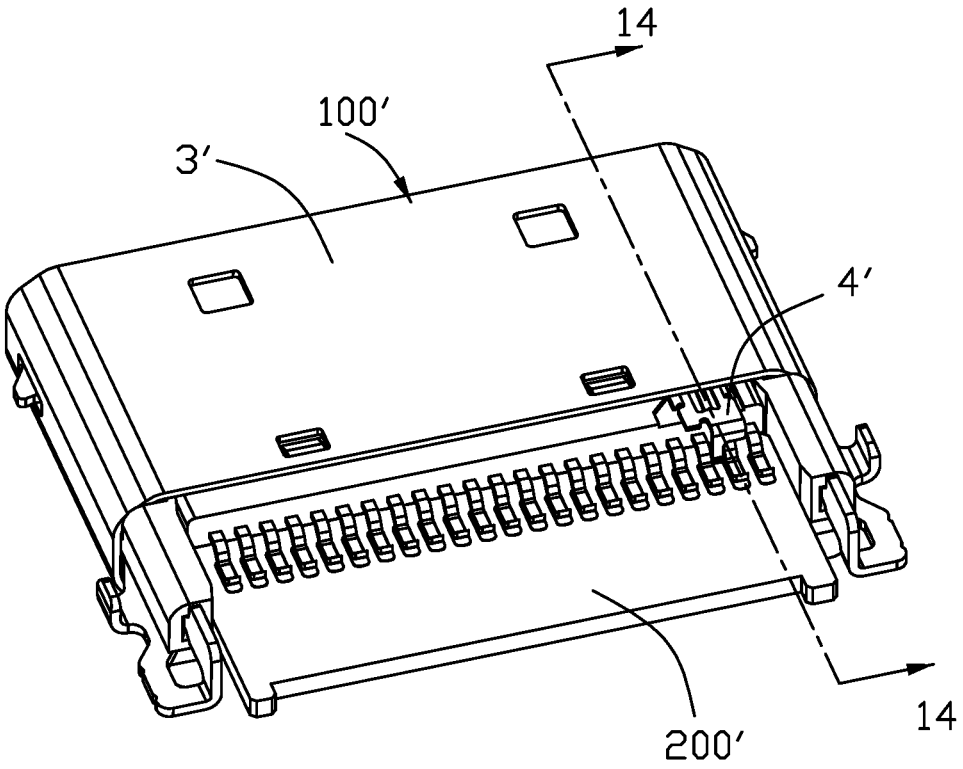
FIG. 9 is a perspective view of an electrical connector in accordance with a second embodiment of the present invention.
Figure 10:
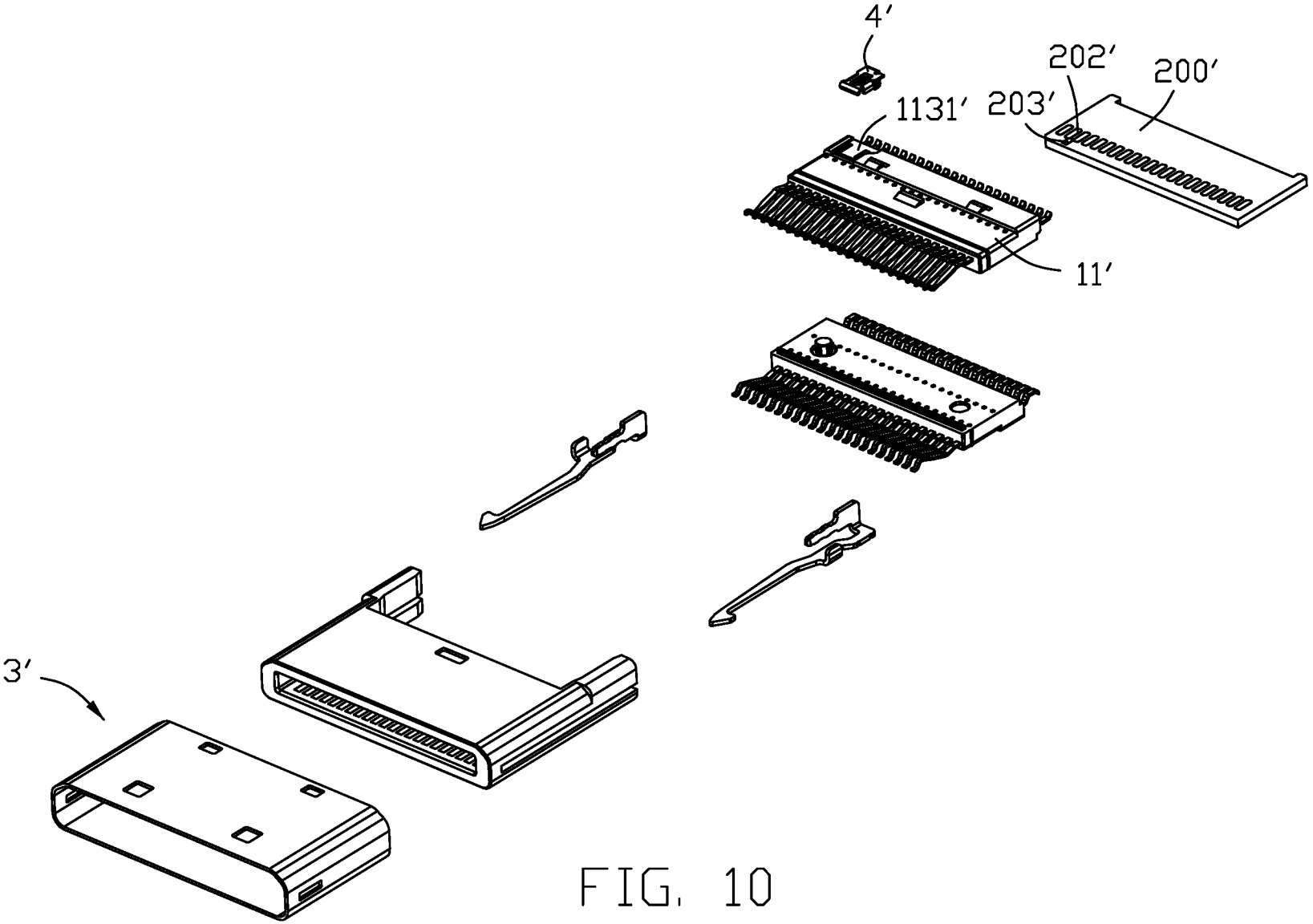
FIG. 10 is an exploded view of the electrical connector in FIG. 9.
Figure 11:
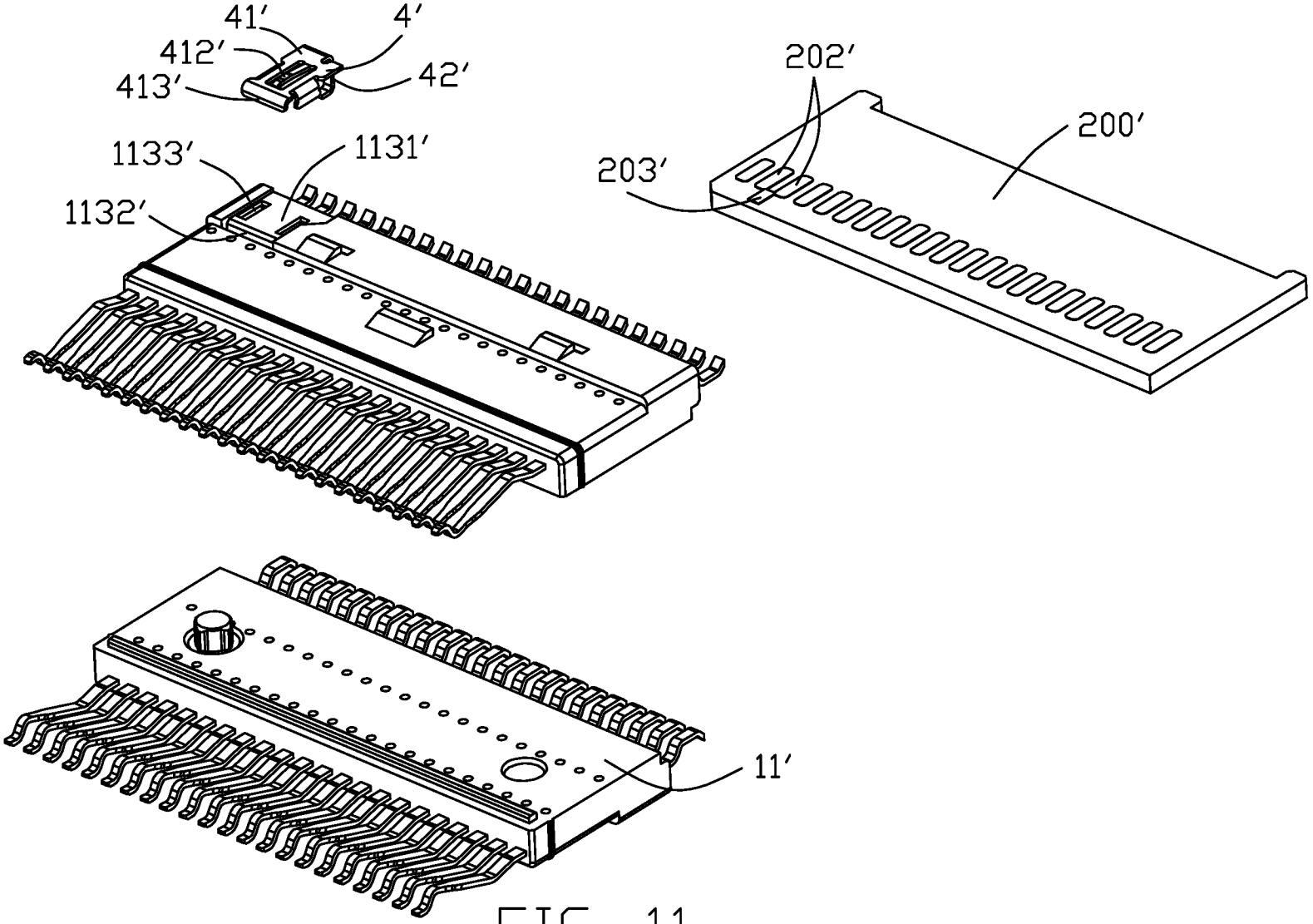
FIG. 11 is an exploded view showing a part of the electrical connector in FIG. 9.
Figure 12:
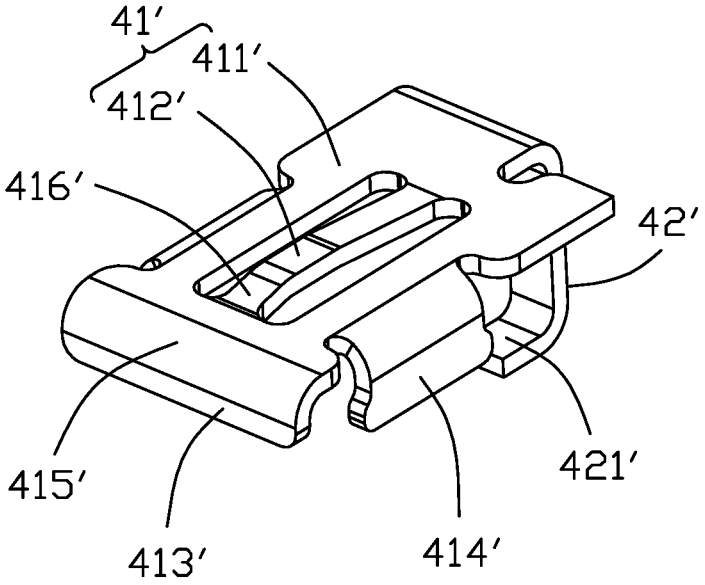
FIG. 12 is a perspective view of a coupling piece of the electrical connector in FIG. 9.
Figure 13:
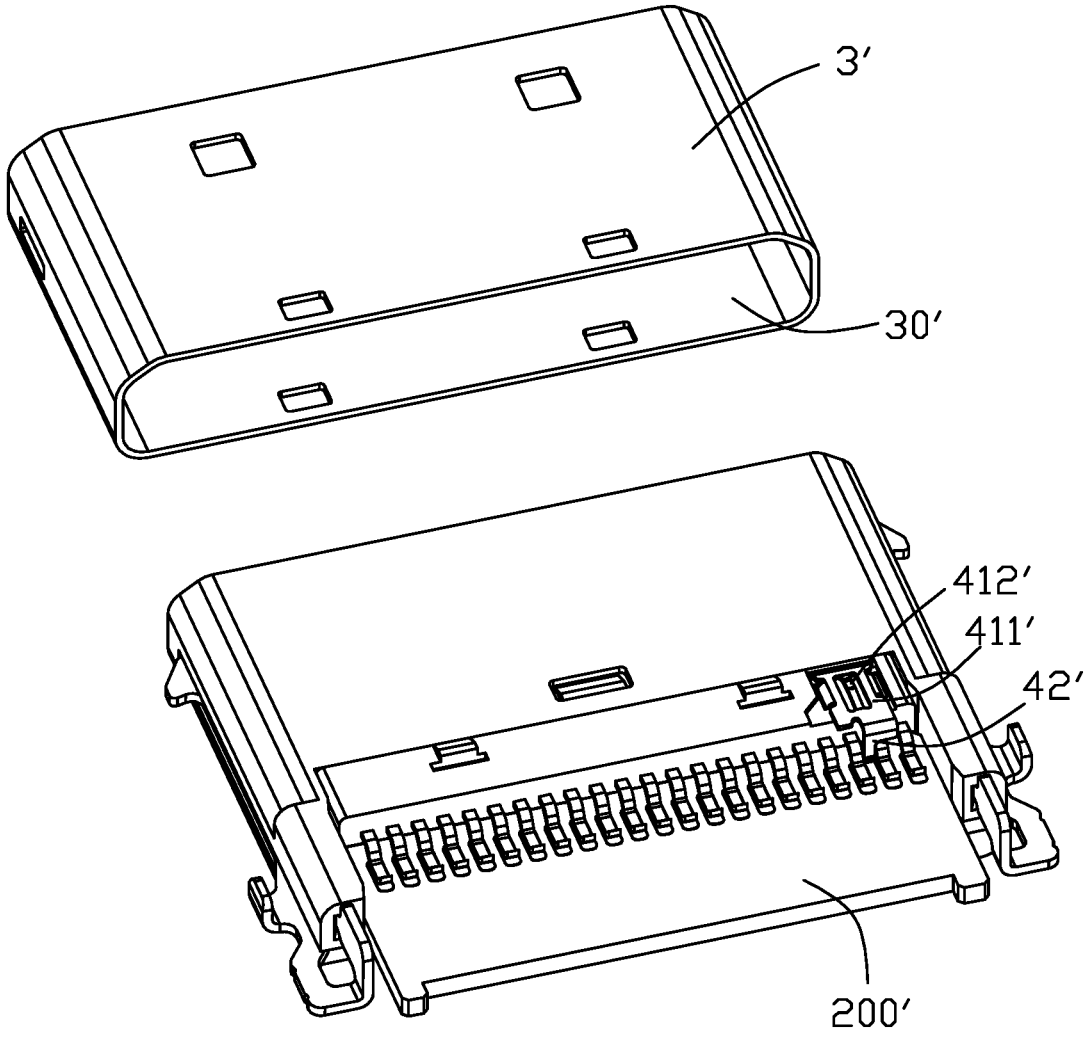
FIG. 13 is a partially exploded view of the electrical connector in FIG. 9.
Figure 14:
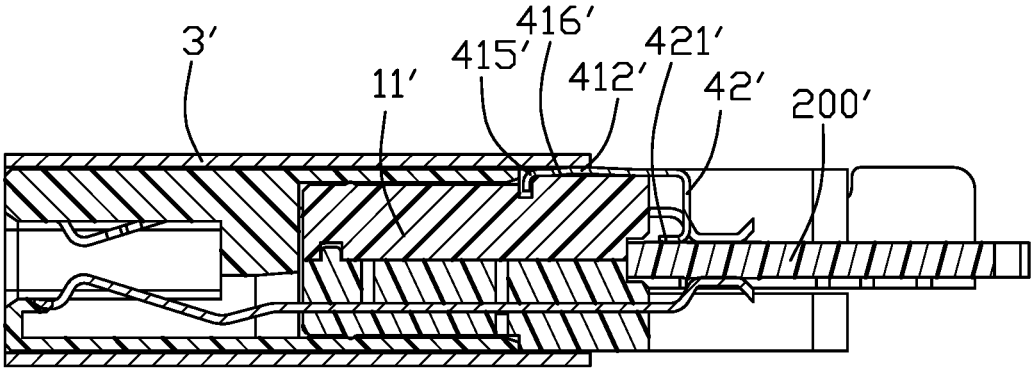
FIG. 14 is a cross-sectional view of the electrical connector taken along line B-B in FIG. 9.

Referring to FIGS. 9-14, an electrical connector 100' of the second embodiment comprises a varied coupling piece 4' in which same or similar elements are identified by same reference numerals plus apostrophe. The planar portion 41' of the coupling piece 4' has a main portion 411', a resilient region such as a beam 412' at a middle thereof, and a retaining portion 413'. The resilient beam 412' extends in a front-to-rear direction and resiliently abuts against the inner surface 30' of the metallic cover 3'. The recess 1131' has a front retaining groove 1132'. The main portion 411' has a pair of bent securing portions 414' and the recess 1131' has a corresponding pair of securing grooves 1133'. The planar portion 41' has a rounded guide face 415' at a junction between the retaining portion 413' and the main portion 411'. A front of the resilient beam 412' has a guide surface 416'. In the second embodiment, the tail portion 42' of the coupling piece 4' has single foot 421' for soldering to a single auxiliary ground pad 203' disposed on the PCB 200'.

Figure 15:
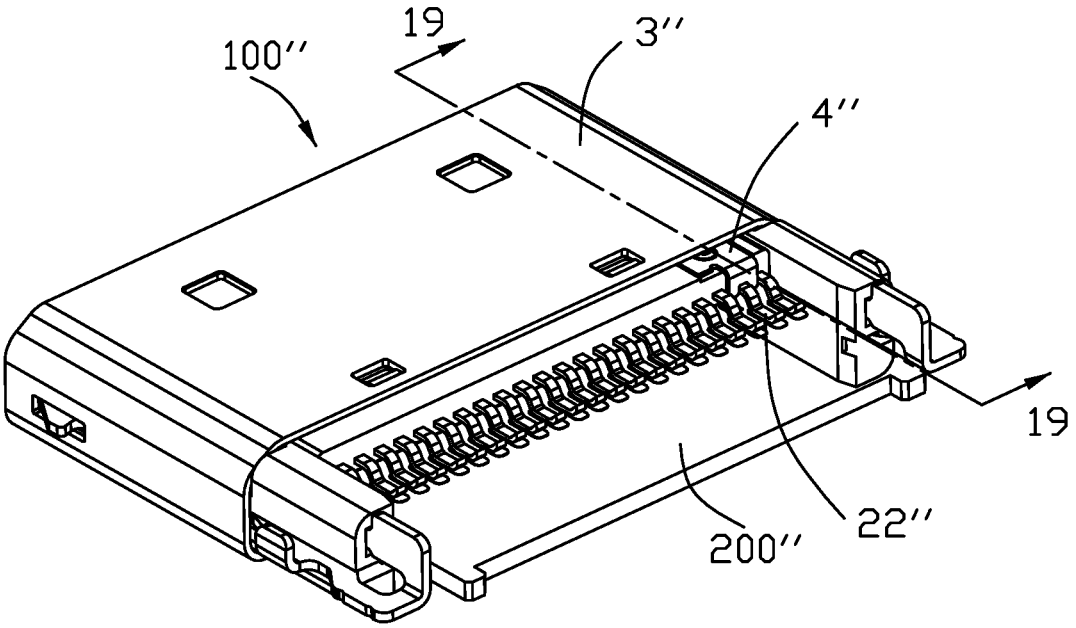
FIG. 15 is a perspective view of an electrical connector in accordance with a third embodiment of the present invention.
Figure 16:
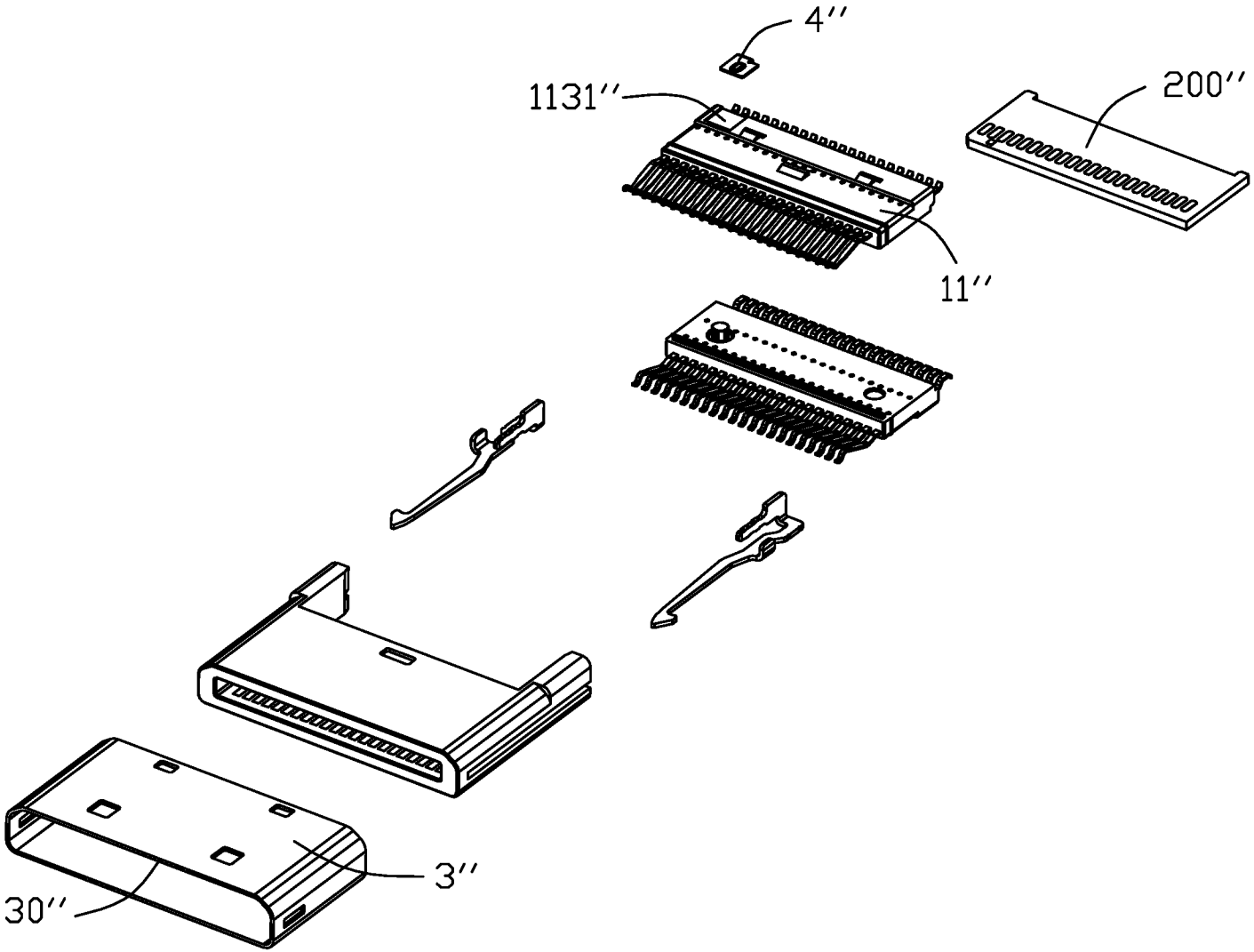
FIG. 16 is an exploded view of the electrical connector in FIG. 15.
Figure 17:
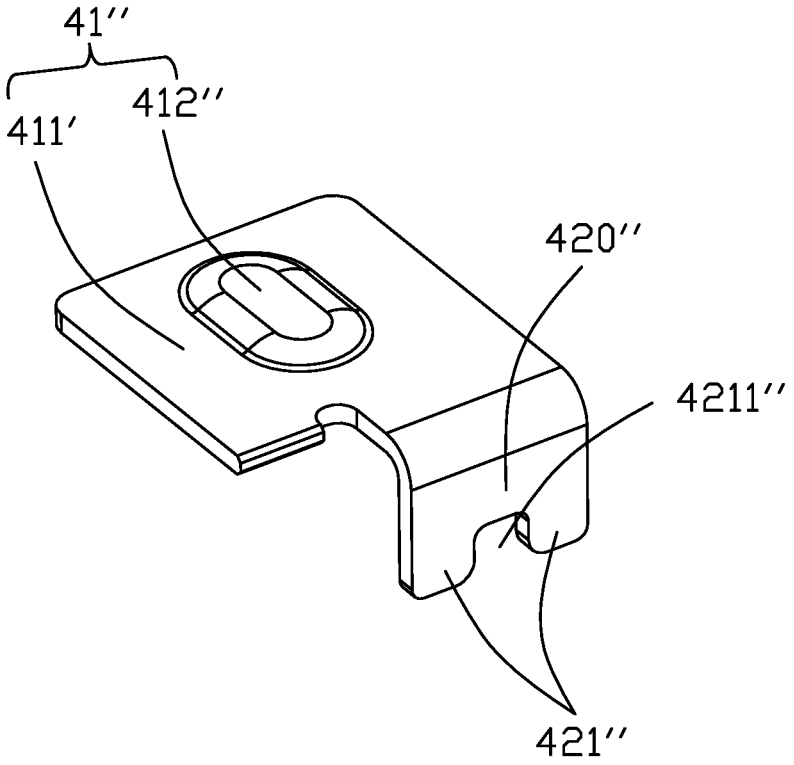
FIG. 17 is a perspective view of a coupling piece of the electrical connector in FIG. 15.
Figure 18:
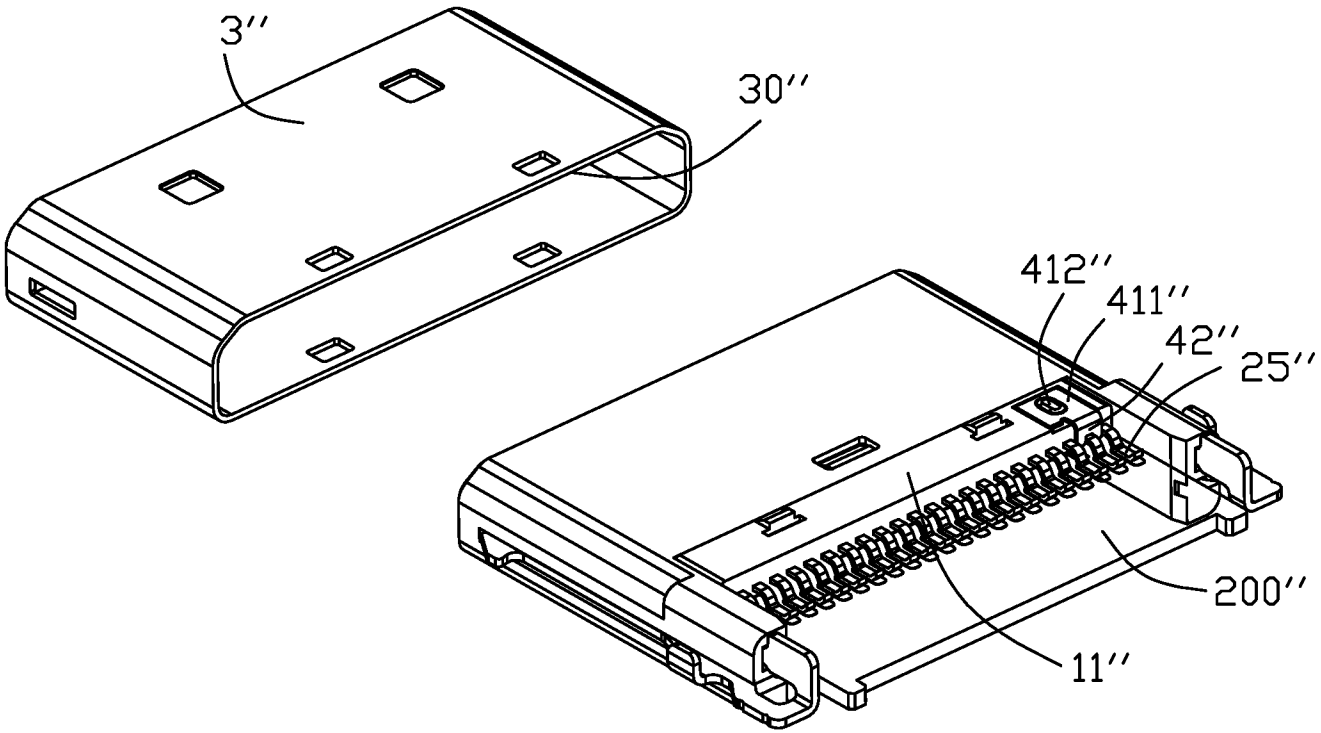
FIG. 18 is a partially exploded view of the electrical connector in FIG. 15.
Figure 19:
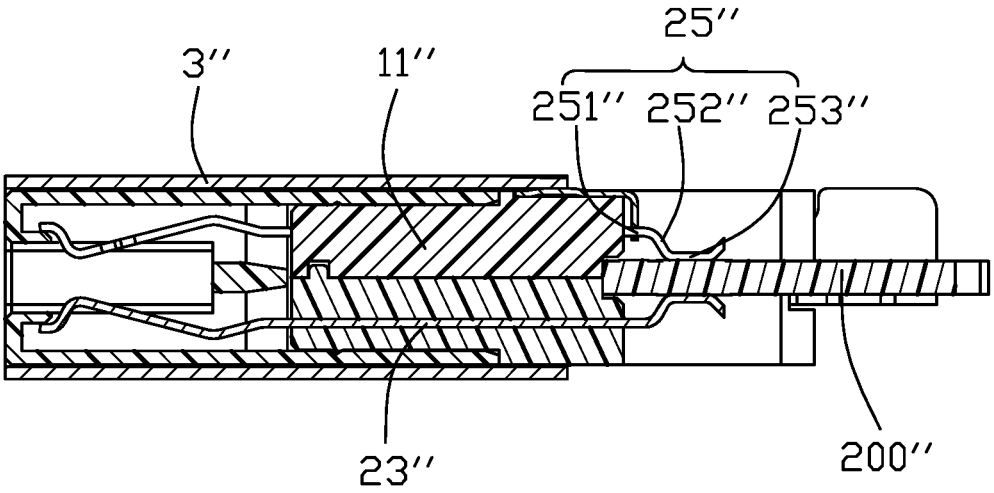
FIG. 19 is a cross-sectional view of the electrical connector taken along line C-C in FIG. 15.
Figure 20:
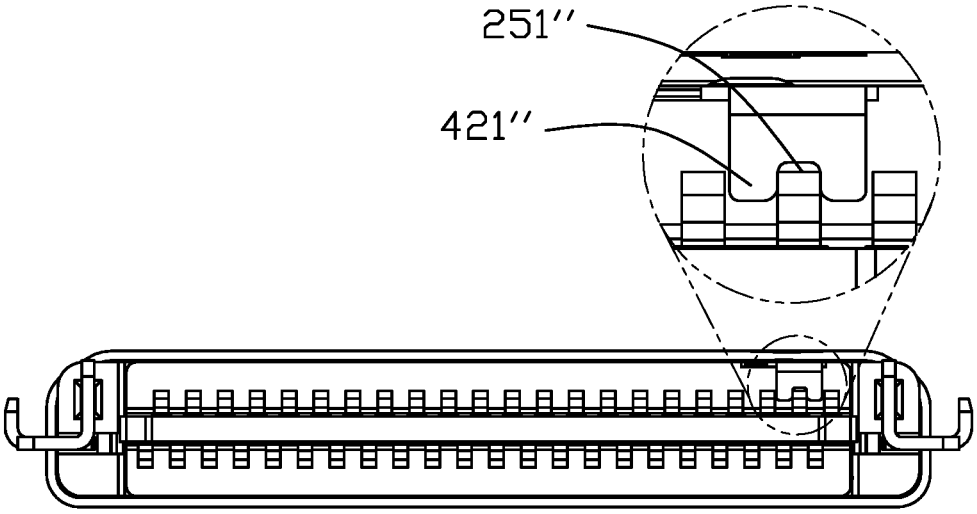
FIG. 20 is a rear plan view of the electrical connector in FIG. 15.

Referring to FIGS. 15-20, an electrical connector 100" of the third embodiment comprises a varied coupling piece 4" in which same or similar elements are identified by same reference numerals plus double apostrophe. The planar portion 41" of the coupling piece 4" has a main portion 411" and a resilient region such as a bulge 412" at a middle thereof. In the third embodiment, the tail portion 42" of the coupling piece 4" has a notch 4211" engaging the tail 25" of a corresponding ground contact 22". Specifically, the tail 25" has an extension 251", an upright 252", and a soldering portion 253". The tail portion 42" of the coupling piece 4" has a base 420" and a pair of legs 421" defining the notch 4211". The extension 251" engages the notch 4211". The bulge 412" has a rounded periphery.

It is contemplated that the coupling pieces of various embodiments may be soldered to the PCB and connected to the ground contact, namely, combining embodiments 1 and 2 with embodiment 3.

What is claimed is:

1. An electrical connector comprising: an insulative housing having a recess at an outer surface thereof; a plurality of contacts secured to the insulative housing and each including a securing portion, a front contacting portion, and a rear tail; an internal printed circuit board (PCB) having a plurality of conductive pads connected to the rear tails of the plurality of contacts and an auxiliary ground pad, the auxiliary ground pad being connected to a corresponding one of the plurality of conductive pads; a metallic cover enclosing the insulative housing; and a coupling piece received in the recess of the insulative housing and connecting the metallic cover to the auxiliary ground pad of the PCB; wherein the coupling piece includes a planar portion having a rounded guide face at a front thereof and a tail portion bent from the planar portion, the tail portion having a foot extending forwardly.

2. The electrical connector as claimed in claim 1, wherein the coupling piece includes a planar portion and a tail portion bent from the planar portion, the tail portion having a foot extending forwardly.

3. The electrical connector as claimed in claim 1, wherein the coupling piece includes a planar portion interference fit in the recess of the insulative housing.

4. The electrical connector as claimed in claim 1, wherein the coupling piece includes a planar portion having a resilient region at a middle thereof.

5. An electrical connector comprising: an insulative housing having a recess at an outer surface thereof; a plurality of contacts secured to the insulative housing and each including a securing portion, a front contacting portion, and a rear tail located outside of the insulative housing; an internal printed circuit board (PCB) having a plurality of conductive pads connected to the rear tails of the plurality of contacts; a metallic cover enclosing the insulative housing; and a coupling piece received in the recess of the insulative housing and connecting the metallic cover to the rear tail of a corresponding ground contact of the plurality of contacts; wherein the coupling piece includes a planar portion having a rounded guide face at a front thereof and a tail portion bent from the planar portion, the tail portion having a notch engaging the corresponding ground contact.

6. The electrical connector as claimed in claim 5, wherein the coupling piece includes a planar portion interference fit in the recess of the insulative housing.

7. The electrical connector as claimed in claim 5, wherein the coupling piece includes a planar portion having a resilient region at a middle thereof.

* * * * *